US009341103B2

(12) United States Patent
D'Epiro

(10) Patent No.: US 9,341,103 B2
(45) Date of Patent: May 17, 2016

(54) DEVICE FOR WATER CIRCULATION IN A COOLING CIRCUIT OF AN INTERNAL COMBUSTION ENGINE

(71) Applicant: FPT Industrial S.P.A., Turin (IT)

(72) Inventor: Clino D'Epiro, Alpignano (IT)

(73) Assignee: FPT INDUSTRIAL S.P.A., Turin (IT)

( * ) Notice: Subject to any disclaimer, the term of this patent is extended or adjusted under 35 U.S.C. 154(b) by 0 days.

(21) Appl. No.: 14/364,112

(22) PCT Filed: Dec. 18, 2012

(86) PCT No.: PCT/EP2012/075980

§ 371 (c)(1),
(2) Date: Jun. 10, 2014

(87) PCT Pub. No.: WO2013/092603

PCT Pub. Date: Jun. 27, 2013

(65) Prior Publication Data

US 2014/0318482 A1 Oct. 30, 2014

(30) Foreign Application Priority Data

Dec. 19, 2011 (EP) ..... 11194335

(51) Int. Cl.
*F01P 7/14* (2006.01)
*F01P 3/00* (2006.01)
(Continued)

(52) U.S. Cl.
CPC . *F01P 3/00* (2013.01); *F01P 7/165* (2013.01); *F01P 7/167* (2013.01); *F01P 7/16* (2013.01);
(Continued)

(58) Field of Classification Search
CPC ..... F01P 7/16; F01P 7/167; F01P 2007/146; F01P 2060/08; F01P 2025/62; F01P 11/04
USPC ..... 123/41.1
See application file for complete search history.

(56) References Cited

U.S. PATENT DOCUMENTS 2,542,902 A 2/1951 Chubbuck
3,162,136 A 12/1964 Clary et al.
(Continued)

FOREIGN PATENT DOCUMENTS

CN 101363354 2/2009
CN 102046982 5/2011
WO WO 9854448 12/1998

OTHER PUBLICATIONS

AB Volvo, Circulation Pump, 2015, AB Volvo pp. 1-2.*

*Primary Examiner* — Lindsay Low
*Assistant Examiner* — Charles Brauch
(74) *Attorney, Agent, or Firm* — Stetina Brunda Garred & Brucker

(57) ABSTRACT

The present invention refers to a device (1) for water circulation in a cooling circuit of an internal combustion engine (3). The device comprises a pump and a suction chamber (8) which develop in a circular way around the axis of the pump impeller. The device comprises also a water manifold (50) that can be connected to the outlet of a radiator (40) of said cooling circuit. The device comprises a first duct (5) connected to the manifold and a first opening (5') which defines an axial inlet for said first flow in said chamber (8). The device comprises also a second duct (6) connected to the manifold (50) and to the suction chamber (8') by means of a second opening (6'). The latter defines a tangential intake for water, so that it is subject to a rotation around the axis of the impeller. The device further comprises flow rate partition means (9) suitable to vary the flow rate of the water circulating in both ducts (5,6) as a function of the operating conditions of said engine.

13 Claims, 12 Drawing Sheets

(51) Int. Cl.
*F01P 7/16* (2006.01)
*F01P 11/04* (2006.01)

(52) U.S. Cl.
CPC ..... *F01P 11/04* (2013.01); *F01P 2003/008* (2013.01); *F01P 2007/146* (2013.01); *F01P 2025/62* (2013.01); *F01P 2060/08* (2013.01)

(56) References Cited

U.S. PATENT DOCUMENTS

2006/0225417 A1* 10/2006 Pantow et al. ..... 60/599
2010/0126474 A1* 5/2010 Siegel et al. ..... 123/508

* cited by examiner

DEVICE FOR WATER CIRCULATION IN A COOLING CIRCUIT OF AN INTERNAL COMBUSTION ENGINE

CROSS REFERENCE TO RELATED APPLICATIONS

The present application claims priority to PCT International Application No. PCT/EP2012/075980 filed on Dec. 18, 2012, which application claims priority to European Patent Application No. 11194335.3 filed Dec. 19, 2011, the entirety of the disclosures of which are expressly incorporated herein by reference.

STATEMENT RE: FEDERALLY SPONSORED RESEARCH/DEVELOPMENT

Not Applicable.

BACKGROUND OF THE INVENTION

1. Field of the Invention

The present invention belongs to the field of the production of industrial vehicles, such as for example commercial vehicles and/or trucks. More precisely the invention refers to a device for water circulation in a cooling circuit of an internal combustion engine, preferably, but not exclusively, of the diesel type. The present invention further relates to a cooling circuit of an internal combustion engine comprising such device and to a commercial and/or industrial vehicle comprising said cooling circuit.

2. Prior Art

As it is known, any vehicle motorized by an internal combustion engine (e.g. diesel engine) must necessarily comprise a cooling circuit of the engine itself, in order to ensure its correct functioning. A cooling circuit of an internal combustion engine, usually comprises a circulation pump and a cooling line which develops downstream of the circulation pump passing through the cylinder block and the cylinder head of the internal combustion engine in order to cool them.

After the heat exchange with said engine elements, the water circulating in the cooling line flows into a radiator where it is cooled by a water/air heat exchange. The cooled air leaving the radiator is thus brought back to the inlet of the circulation pump in order to pass through the circuit again. Usually the cooling circuit comprises also a bypass line regulated by a the thermal expansion valve. More precisely, such thermal expansion valve has the function of diverting the water directed to the radiator into the bypass line when the temperature of the water is below a predetermined characteristic value, usually when the engine is in its start phase. When the water temperature exceeds such predetermined value, then the thermal expansion valve chokes/splits the water flow from the cooling line in a first fraction circulating in the bypass line and in a second fraction directed to the radiator. When the water temperature exceeds a second predetermined value, then the thermal expansion valve directs the whole water flow rate towards the radiator, blocking the passage in the bypass line.

In the most recent solutions, the water flow rate leaving the circulation pump (in the following indicated also by delivery flow rate) is regulated as a function of the operating conditions of the internal combustion engine, namely as a function of the load and of the speed of the engine itself. In particular, in partial load conditions, the delivery flow rate is reduced in order to limit the cooling of the engine and to avoid an overcooling of the cylinders, namely an overcooling of the oil. Such negative condition, indeed, would result in an increase of its viscosity and thus in an increase of the frictions of the engine. At present, the delivery flow rate regulation is performed according to two different solutions, which, however, are not advantageous in terms of costs, efficiency and reliability.

A first known solution provides the use of a control in order to vary, without depending on the engine, the speed of rotation of the pump. Such control is usually formed by an electric motor with adjustable speed which drives directly the impeller shaft of the pump. The reduction of the delivery flow rate is varied by varying the speed of the electric motor, which results in a variation of the speed of rotation of the impeller. The electric motor is controlled as a function of the water temperature and thus of the operating condition of the internal combustion engine. The variation of the speed of the impeller results in a variation of the pump head, and thus of the delivery flow rate.

Even though this solution is relatively effective in terms of delivery flow rate regulation, it has evident disadvantages in terms of efficiency. In particular, converting the energy that is necessary for the functioning of the electric motor is a very critical factor in terms of efficiency. Moreover, it has to be noted that in case of failure of the electric motor or of the circuit that controls the motor itself, the circulation pump will not work, and thus water will not circulate in the cooling line. In these conditions the risk of burning out the engine is high, since the heat is no longer dissipated. It is thus evident that activating the hydraulic pump without depending on the driving shaft is unacceptable in terms of reliability, above all for heavy industrial vehicles whose life usually exceeds one million kilometers.

An alternative known solution provides the use of an electromagnetic coupling between the pulley driven by the driving shaft by means of a mechanical transmission and the rotating shaft of the impeller of the hydraulic pump. The electromagnetic couplings allows, if necessary, a slipping between pulley and impeller, which implies a variation in the speed of the impeller itself, namely a variation of the delivery flow rate.

Compared to the previous solution, this second solution makes the engine more reliable, since in case of a failure of the electromagnetic coupling, the hydraulic pump keeps working, allowing the circulation of the cooling water. In terms of costs, however, the electromagnetic coupling is extremely expensive, and it has a very low efficiency, from an operating point of view, usually around 60%. This aspect is partially prejudicial to the reduction of absorbed power, above all at low speed. Consequently a relevant part of the power saving at the pump shaft is negatively compensated by the low efficiency of the transmission of the coupling. Even though the energy balance is positive, overall, this second solution is still unsatisfactory.

From these considerations, the need for an alternative technical solution, allowing to overcome the aforementioned limits and the drawbacks of the prior art, emerges.

Consequently the main task of the object of the present invention is to provide a device for water circulation in a cooling circuit of an internal combustion engine, which allows to overcome the drawbacks mentioned above.

In the scope of this task, a first aim of the present invention is to provide a device for water circulation which does not affect negatively the safety of the internal combustion engine in case of failure.

Another aim of the present invention is to provide a device for water circulation which is not based on the use of an electromagnetic coupling or of an electric motor.

Not least, the purpose of the present invention is to provide a device for water circulation which is reliable and easy to manufacture with competitive costs.

SUMMARY OF THE INVENTION

The present invention thus refers to a device for water circulation in a cooling circuit of an internal combustion engine, according to what stated in claim 1.

The device according to the invention allows to vary the pump delivery flow rate by varying the conditions of the water flow at the inlet of the pump which results in a variation of the characteristic curves of the pump. In particular such variation of the suction conditions is obtained by a modulation of the flow rate of the first flow in the first duct and of the second flow in the second duct. Compared to the traditional solutions, the device according to the invention ensures a delivery flow rate of the pump even in case of failure of the partition means. At the same time, the device has a high efficiency and a high reduction of the power absorbed by the pump, above all for low delivery flow rates.

BRIEF DESCRIPTION OF THE DRAWINGS

Further characteristics and advantages will become more evident from the following detailed description of embodiments of a pump for an industrial vehicle according to the present invention, that is shown in a merely illustrative and not limitative form in the attached drawings wherein.

In the figures the same reference numbers and letters identify the same elements or components.

DETAILED DESCRIPTION OF THE INVENTION

Figure 1:
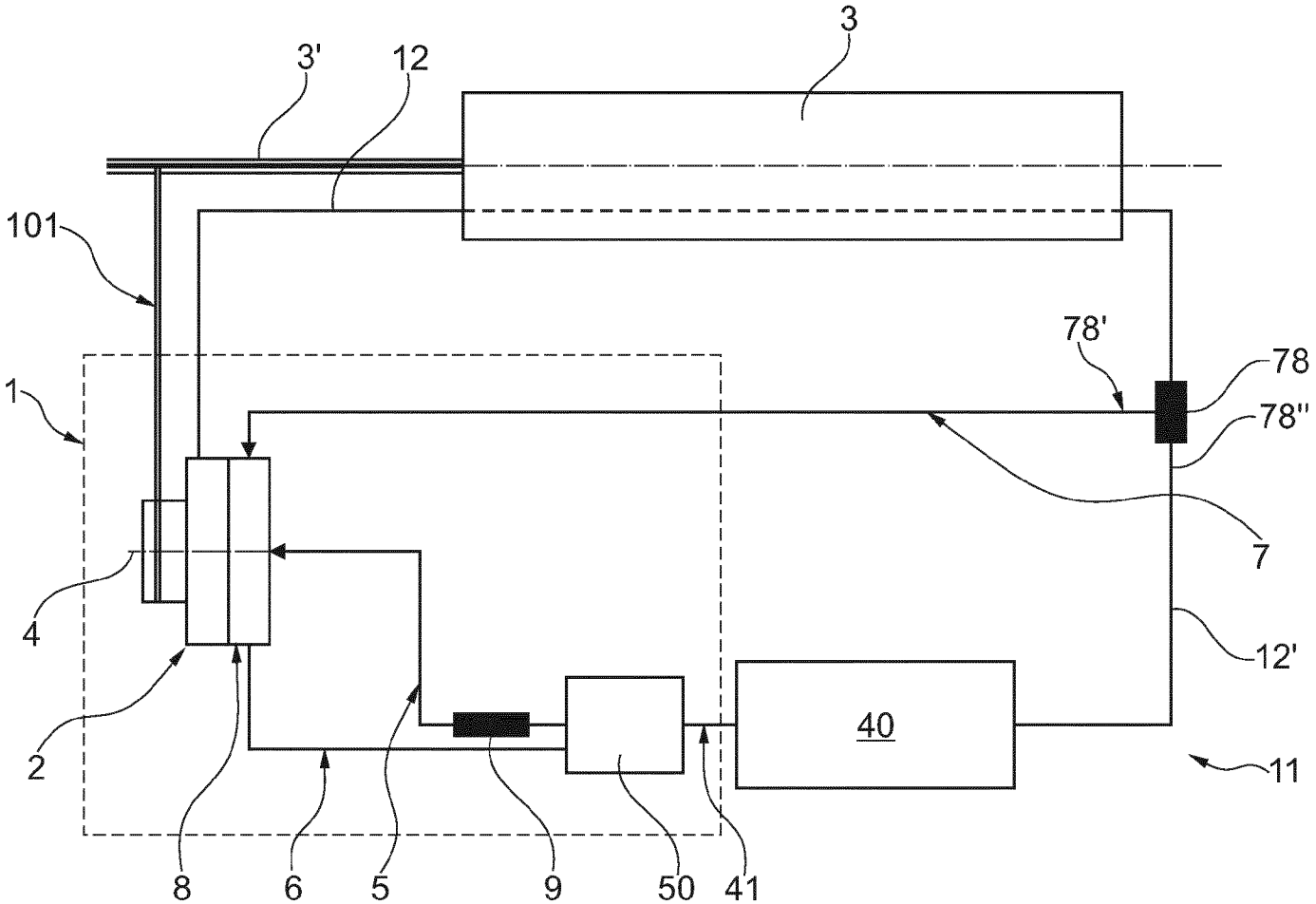
FIG. 1 shows a schematic view of a cooling circuit of an internal combustion engine comprising a device according to the present invention.
Figure 2:
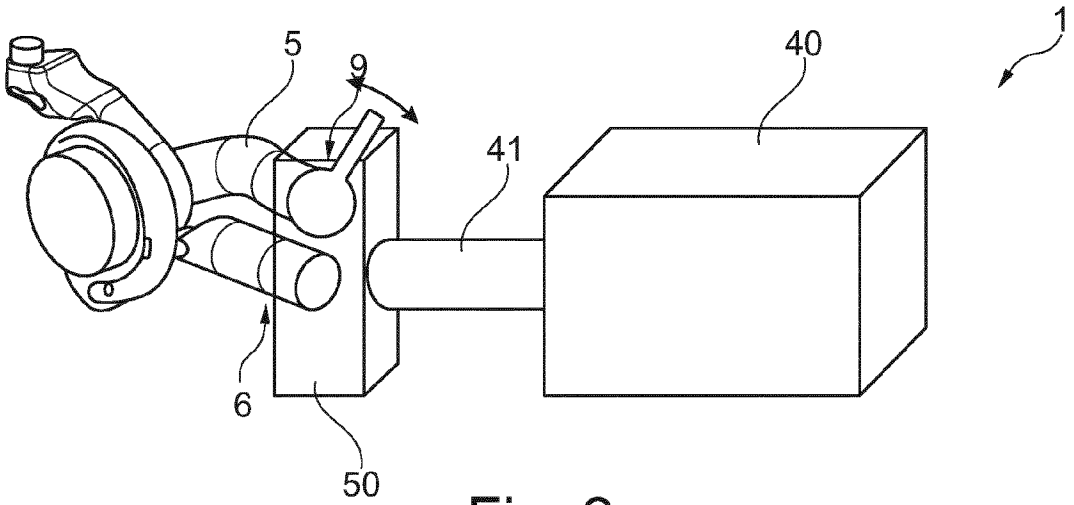
FIGS. 2 and 3 show schematizations from different points of view of a device according to the present invention.
Figure 3:
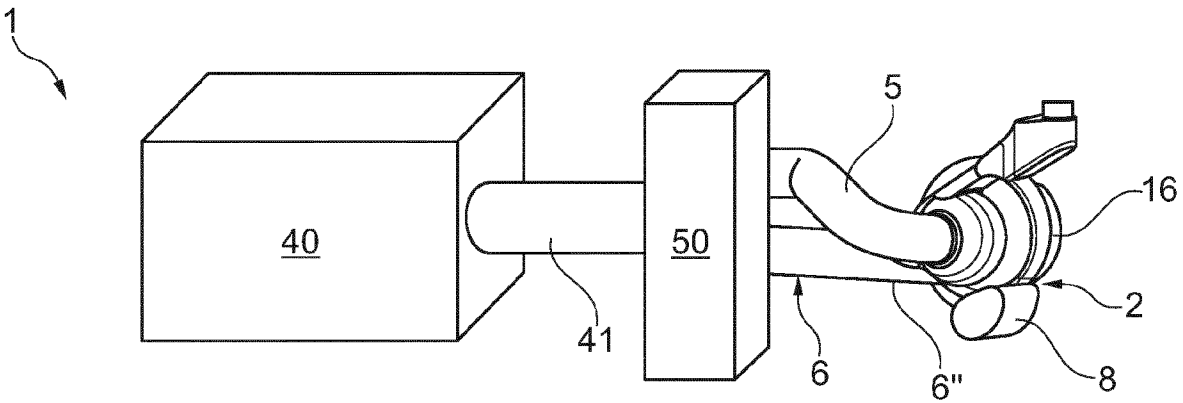

The present invention thus refers to a device 1 for water circulation in a cooling circuit of an internal combustion engine, preferably, but not exclusively, of the diesel type. In this regard, FIG. 1 shows a schematization of a cooling circuit of an internal combustion engine 3 of a transport vehicle (e.g. an industrial or commercial vehicle) comprising a device 1 according to the present invention. FIGS. 2 and 3 show, instead, two schematizations, from different points of view, of an embodiment of the device 1 according to the invention.

Thus with reference to the aforementioned FIGS. 1, 2 and 3, the device 1 comprises a water circulation pump (in the following simply referred to as pump) that can be directly activated by the driving shaft 3' of the engine 3 by means of a mechanical transmission 101 (e.g. a belt drive) according to a principle per se known. Such pump comprises a body which defines a housing 16 (in the following also indicated by "stator duct" 16) within which a bladed impeller 15 is placed and rotates around an axis of rotation 4. According to a preferred embodiment of the invention described below and shown in figures from 9 to 15, the body may advantageously be defined by a portion (indicated by number 2) of the crankcase of the internal combustion engine. As an alternative, the body may be separated from the crankcase, for example in case of relatively small engines.

In addition to the stator duct 16, the body defines also a suction chamber 8 (in the following indicated also by "chamber 8") which develops substantially in a circular way around the axis 4 of the impeller 15 of the pump. This means that the chamber 8 is shaped so that any cross section of the chamber itself has a circular configuration. In this regard, the expression "cross section" means a section evaluated with respect to a plane defining an orthogonal section of the axis 4 of the impeller 15.

The chamber 8 communicates with the stator duct 16 where the impeller 15 of the pump is placed, substantially defining a suction section 8' for the impeller itself. In other words, the expression "suction section" means the circular opening, substantially orthogonal to the axis 4 of the impeller 15, that makes the chamber 8 communicating with the stator duct 16.

The device according to the invention comprises a manifold 50 suitable to be placed at the outlet 41 of a radiator 40 of the hydraulic circuit, so that the whole water flow rate leaving the radiator 40 flows into the inlet of the manifold 50. In FIGS. 2 and 3 the manifold 50 is schematized as "a box" collecting water. In a possible embodiment, not shown in the figures, it can be formed by a sleeve with only one inlet, connected to the radiator 40, and two separated outlets for the purposes described below.

The device according to the invention comprises, indeed, also a first supply duct 5 of the chamber 8 connected to a first outlet of the manifold 50, in order to be passed through by a first water flow leaving the manifold itself. Such first duct 5 is hydraulically connected to the suction chamber 8 by means of a first opening 5' of the chamber 8. The latter defines an "axial inlet" for the first water flow in the chamber itself. The expression "axial inlet" refers to a condition so that said first water flow, passing through the first opening 5', takes a direction substantially parallel to the axis 4 of the impeller 15.

The device 1 according to the invention comprises also a second supply duct 6 of the chamber 8 connected to a second outlet of the manifold 50, independent of the first, so that it is passed through by a second water flow leaving the manifold itself and independent of the first flow. Such second duct 6 is hydraulically connected to the chamber 8 by means of a first opening 6' which defines a "tangential inlet" in said chamber 8 for the second water flow in said chamber. In particular the expression "tangential inlet" refers to a condition so that the second water flow, passing through the second opening 6', enters the chamber by rotating around the axis of rotation 4 according to a whirling motion also called "swirl motion". In other words the second flow enters the chamber 8 in a tangential way with respect to the surface of the chamber itself. Due to the circularity of such surface, the water of the second flow is brought to rotate around the axis 4 of the impeller 15.

The device 1 according to the invention further comprises flow rate partition means 9 suitable to vary the flow rate of the water circulating in the first duct 5 and in the second duct 6 as a function of the operating conditions of the engine, namely according to the higher or the lower delivery flow rate requirement of the circulation pump. The partition means 9 thus have the function to split the water flow rate from the radiator 40 between the first duct 5 and the second duct 6 as a function of the delivery flow rate requirement of the pump.

More precisely, when the engine 3 works in full load conditions, namely when the highest pump delivery flow rate is required, the partition means 9 have a first operating configuration so that the water can leave the manifold only through the first duct, consequently cancelling the flow rate of the second flow in the second duct 6. In other words, with the engine in full load condition, the partition means 9 inhibit the passage of water through the second duct 6 so that only the first flow 5 can enter the suction chamber 8 in axial direction. In these conditions, the hydraulic pump works as a traditional centrifugal pump with axial suction providing, being the speed of the impeller 15 the same, the highest head, namely the highest delivery flow rate.

As the engine load decreases, namely when the highest pump delivery water flow rate is not required, the partition means 9 have at least a second operating configuration such that the flow rate of the first flow circulating in the first duct 5 is decreased and, consequently, the flow rate of the second flow in the second duct 6 is increased. This second operating configuration substantially make the partition means 9 increase the water flow rate passing through the tangential opening 6' of the chamber 8 by decreasing the water flow rate passing through the axial opening 5'.

The partition means may advantageously have a third operating configuration so that the flow rate leaving the manifold 40 passes only through the second duct 6, substantially cancelling the first flow passing through the first duct 5. This third operating condition is characteristics of an engine operating condition where the minimum water delivery flow rate is required to the centrifugal pump.

Compared to the full load conditions, when the engine is in partial load conditions the partition means 9 allow to vary the conditions of the flow within the chamber 8 and consequently the conditions in correspondence of the suction sections 8' of the impeller 15. Indeed, the speed components that are characteristics of the "swirl motion" of the second flow are added to the speed axial components that are characteristics of the first flow. It has been observed that this variation in the conditions of the flow results in an advantageous variation of the characteristic operating curves of the pump. In particular, it has been observed that the "swirl motion" of the second flow determines, being the speed of rotation of the pump the same, a decrease in the head provided by the pump and consequently a decrease of the delivery flow rate.

Figure 5:
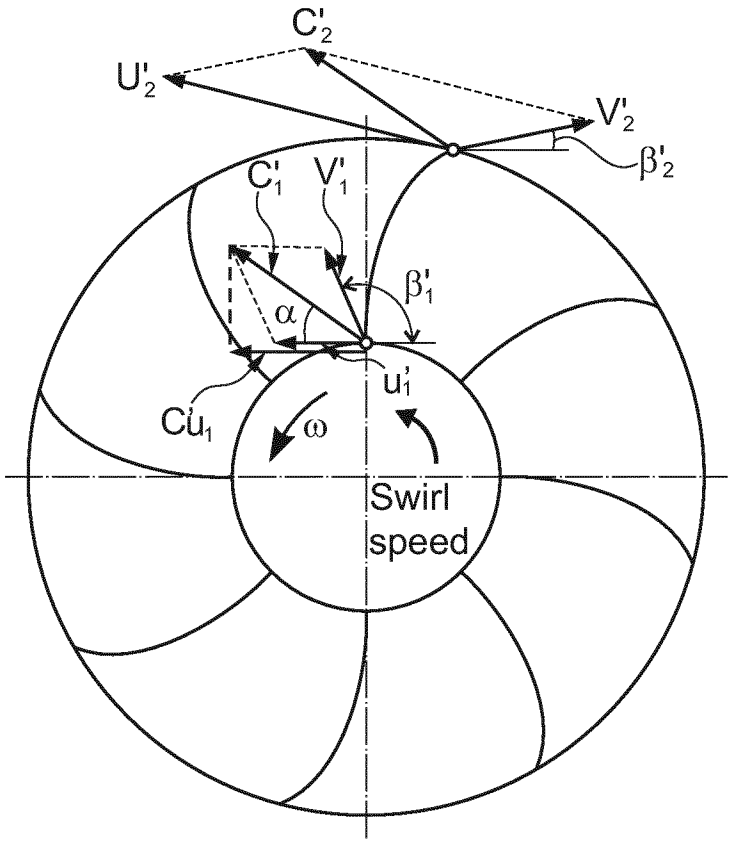
FIGS. 4 and 5 show radial sections of a centrifugal pump of a device according to the present invention.
Figure 4:
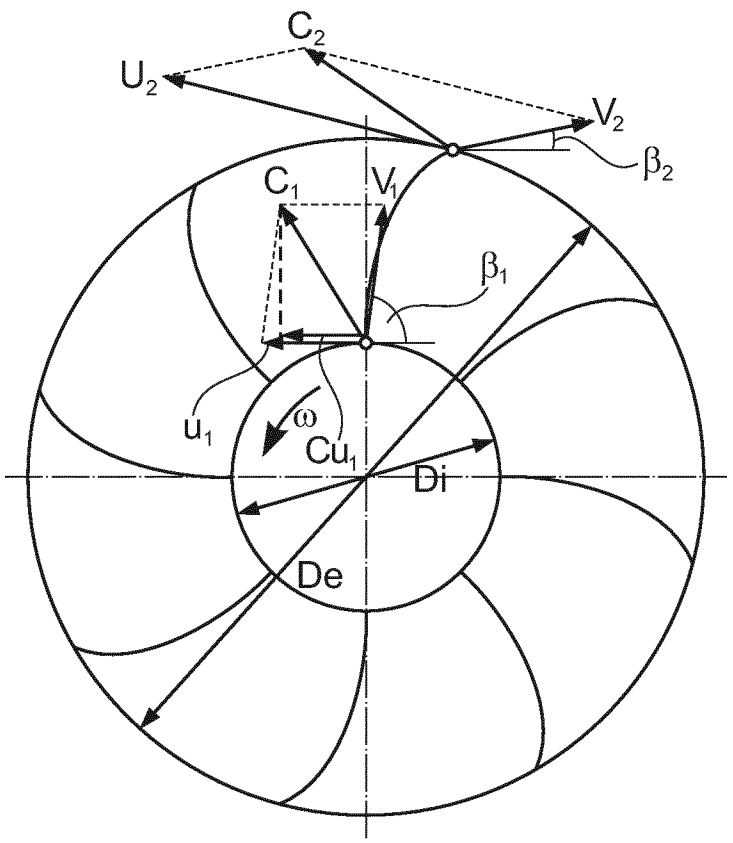

In this regard, FIGS. 4 and 5 show a schematization of a radial section of a centrifugal pump of a device according to the present invention, the water "swirl motion" respectively being absent and present within the suction chamber 8, namely the second flow being absent and present through the second duct 6. In particular FIGS. 4 and 5 show the so called "speed triangles" of water at the inlet and at the outlet of the bladed impeller. In particular references $c_1$ and $c_2$ indicate the absolute speed of the water respectively at the inlet and at the outlet of the impeller. $v_1$ and $v_2$ indicate instead the speed of the fluid in relation to the impeller, namely in relation to a reference system that is integral with the blades. Finally $u_1$ and $u_2$ indicate respectively the tangential speeds of the blades of the impeller in correspondence of, respectively, the external diameter De and of the internal diameter Di of the bladed impeller.

The head $\Delta H_E$ of the centrifugal pump, namely the increase of specific energy provided by the pump impeller to the water, may be calculated, in an ideal fluid dynamics model, by means of the known Euler equation below:

$$\Delta H_E = u_2 C_{u2c} - u_1 C_{u1c};$$

wherein $C_{u2c}$ and $C_{u1c}$ are respectively the tangential components of the absolute speeds $c_1$, $c_2$ of the fluid in correspondence of, respectively, the external diameter De and of the internal diameter Di of the bladed impeller. The component Cu2*c* depends on the geometry of the impeller, while the component Cu1*c* depends on the conditions of the water entering the impeller.

FIG. 5 shows the speed triangles of the impeller when a "swirl motion" is present in the suction chamber. In particular, the angle of incidence is indicated by the reference $\beta_1'$, the absolute speed by the reference c1', the relative speed by the reference v1' and the tangential speed of the impeller by the reference u1'. Compared to the conditions of FIG. 4, the presence of the "swirl motion" determines an increase of the angle of incidence so that the value $\beta_1'$ is higher than the value $\beta_1$. Consequently, when the swirl motion is present, the direction of the absolute speed c1' and the direction of the relative speed v1' are different from the corresponding speeds (indicated by c1 and v1 in FIG. 4) when the swirl motion is absent. The radial speed, on the contrary, is constant (namely $u_1 = u_1'$). In particular, as the angle of incidence $\beta_1'$ increases, the angle $\alpha$, defined between the tangential direction $u_1'$ and the absolute speed direction $C_1'$, decreases. This results in an increase of the tangential component (indicated by Cu1') of the absolute speed $C_1'$. This condition results, in its turn, in a decrease of the head provided by the pump and, finally, in a decrease of the delivery flow rate of the pump itself.

From what is indicated above, it emerges that the partition of the two flows performed by the partition means 9 of the device according to the invention allows to vary, in fact, the characteristic curve "head-flow rate" of the centrifugal pump as a function of the pump delivery flow rate actually required. Unlike the traditional solutions, this variation of the characteristic curve is advantageously obtained without any intervention on the centrifugal pump activation, namely without varying the speed of rotation of the latter.

Figure 6:
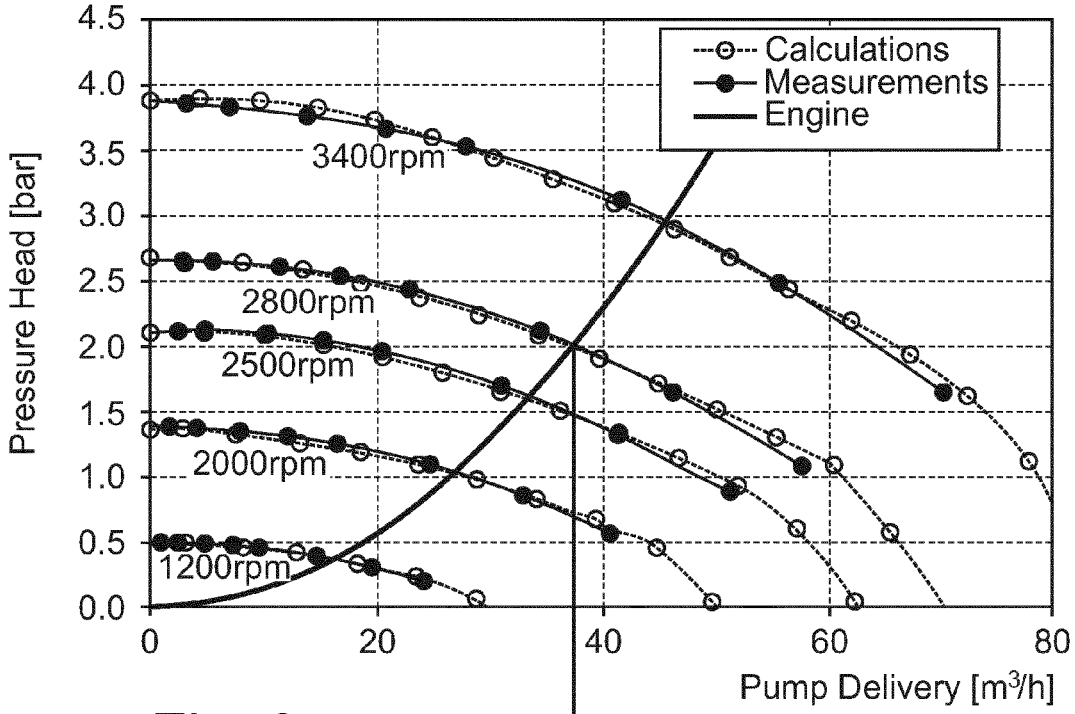
FIGS. 6 and 7 show the characteristic curves of a circulation pump of a device according to the present configuration of a first possible operating configuration.
Figure 7:
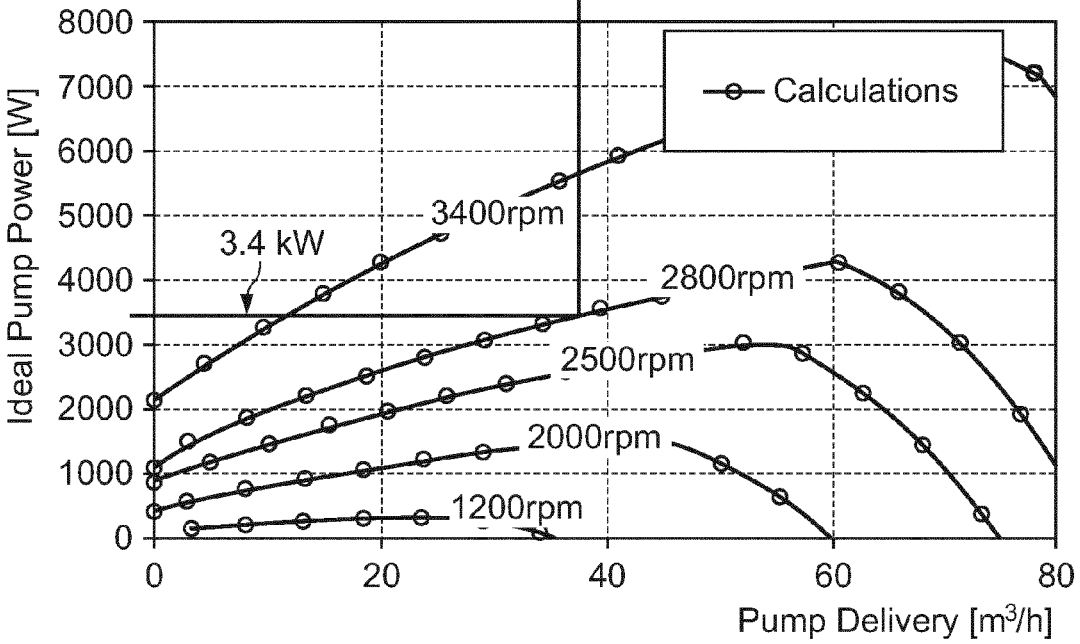
Figure 8:
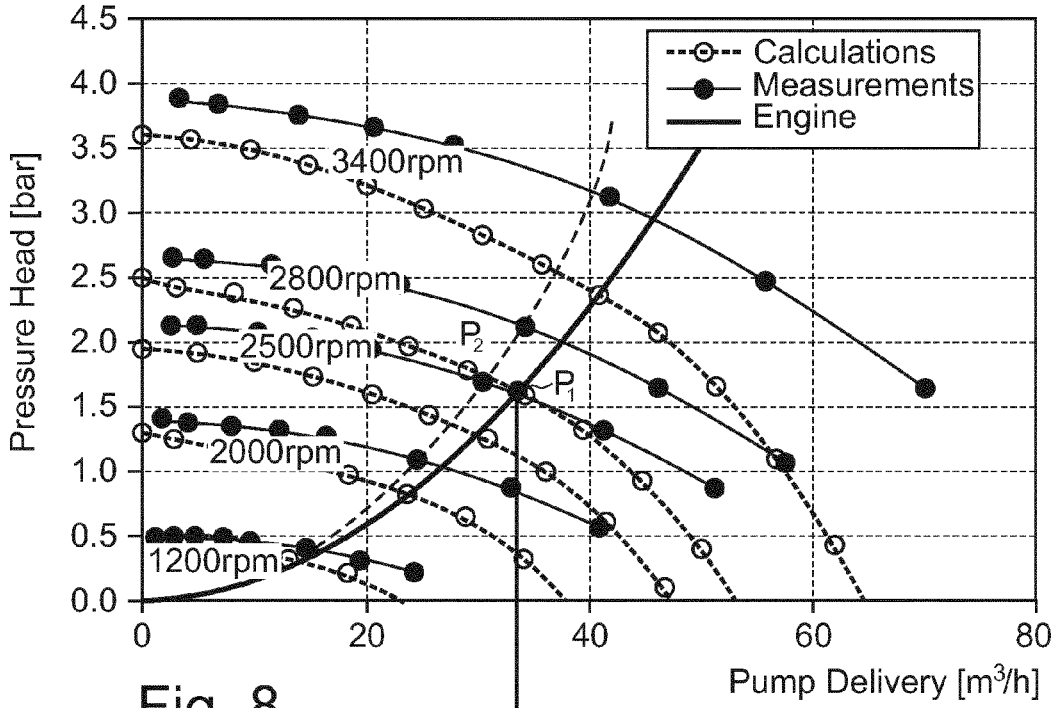
FIGS. 8 and 9 show the characteristic curves of a circulation pump of a device according to the invention in a second possible operating configuration.
Figure 9:
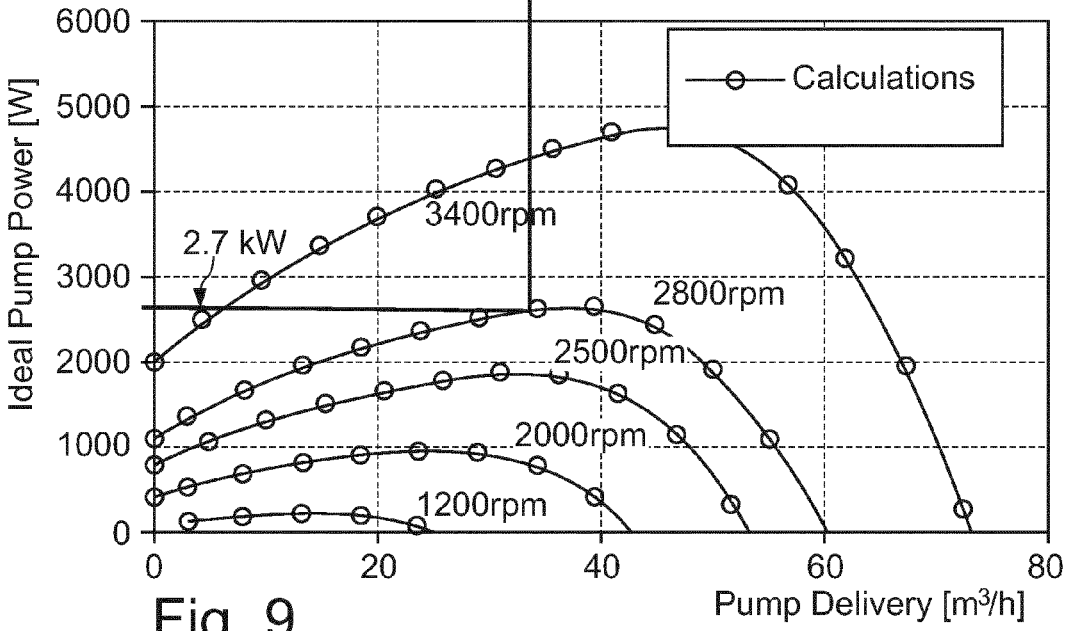

In this regard, FIGS. 6 and 7 show characteristic curves of a pump of a device according to the invention, when only the first flow enters the chamber 8, namely without any "swirl motion" in the chamber itself. FIGS. 8 and 9 show, on the contrary, the characteristic curves of the pump itself when only the second flow is present, namely when a swirl motion is present within the chamber 8.

More precisely, FIG. 6 shows the characteristic curve of the delivery pressure [Bar] of the pump as a function of the delivery flow rate [$m^3$/h]. In this sense it can be observed that for this kind of application, the delivery pressure of the pump is substantially a direct measure of the head provided by the pump. In FIG. 6 each curve with solid circles indicates the characteristic pressure-flow rate (in the following indicated by P-Q) "measured" for a specific speed of rotation of the pump (1200, 2000, 2500, 2800, 3400 rpm). In the same FIG. 6, for each speed of rotation, a corresponding curve with empty circles indicates the curve P-Q obtained by a mathematical model based substantially on Euler equations. The latter consider the conditions of the flow and, in this specific case, the conditions of only the first flow in the suction chamber (absence of "swirl motion" relating to the second flow). More precisely, such equations take account of the speed, in terms of direction and intensity, at the inlet and at the outlet of the impeller, and also of the flow resistance that develops due to the interaction of the water with the impeller. As it can be seen from the diagram of FIG. 6, the mathematical model brings to a substantial correspondence, for any considered speed of rotation, between the curve derived by the model itself (empty circles) and the real measured curve (solid circles).

The continuous line in the diagram of FIG. 6 shows the "system curve" where the considered pump is inserted. The system curve shows the delivery pressure required to move a certain flow rate of fluid by taking into account the flow resistance of the cooling circuit where the pump is placed. For each speed of rotation, the point of intersection between the system curve and the characteristic curve P-Q indicates the "point of work" of the pump. The diagram of FIG. 7 shows a set of curves each one of them showing, for a specific speed of rotation of the impeller (1200, 2000, 2500, 2800, 3400 rpm) the trend of the power (indicated by Pa) absorbed by the pump [kW] as a function of the pump delivery flow rate [$m^3$/h]. By combining the diagram in FIG. 6 with the one in FIG. 7, it is possible to obtain the power absorbed by the pump for a determined "point of work". Considering, for example, a speed of rotation of 2800 rpm, it can be observed that the point of work of the pump on the diagram of FIG. 6 corresponds to an absorbed power of 3.4 kW as can be derived from FIG. 7.

FIG. 8, on the contrary, shows a diagram corresponding to the one of FIG. 6, where in addition to the measured characteristic curves P-Q (solid circles curves) of the pump, also the curves P-Q of the same pump obtained by the mathematical model, are shown, but with only the second flow entering the chamber 8. In other words, these curves have been derived according to the hypothesis that the suction chamber 8 is fed by the second duct 6, namely without the first flow. Thus the curves of FIG. 6 are characteristics of only the "swirl motion" in the chamber 8 due to the tangential inlet of the second flow through the second opening 6'.

The diagram of FIG. 8 clearly shows that, being the considered speed of rotation the same, when the swirl motion is present in chamber 8 (namely in presence of the second flow entering the chamber), the curve P-Q "lowers" towards the direction indicated by the arrow. In other words, compared to a condition with only an axial flow, pressure and pump delivery flow rate decrease. This means that the rotation of the water in the chamber 8 (swirl motion), being the considered speed of rotation the same, the circulation pump provides a lower head, namely does less work and consequently absorbs less power.

In this sense FIG. 9 shows the trend of the characteristic curves absorbed power-flow rate (Pa-Q) in presence of only the "swirl motion" in the chamber 8. By combining the diagram of FIG. 8 with the one of FIG. 9 and considering a speed of rotation of 2800 rpm, it can be observed that, when the swirl motion is present, the "point of work" of the pump lowers with respect to the one of FIG. 6 (namely the point of work is characterized by a lower delivery pressure and a lower flow rate with respect to the one of FIG. 6). Consequently the power absorbed by the pump is lower than in case of absence of the swirl. In the specific example, for a speed of 2800 rpm the absorbed power in presence of swirl motion is about 2.7 kW against 3.4 kW in absence of swirl motion (FIG. 7).

It is thus evident that the device 1 according to the invention allows to vary the pump delivery flow rate by a modulation of the conditions of the water flow within the chamber 8, namely at the inlet of the impeller 15. In particular, the variation of the conditions of the water flow within the chamber is obtained by modulating, by means of the partition means 9, the flow rate of the first and of the second flow entering the chamber itself, namely by decreasing or cancelling, depending on the cases, the swirl motion within the chamber itself. As already explained above, this principle is completely different from the traditional solutions, where a variation of the flow rate is obtained by varying the speed of the impeller all the time.

Figure 10:
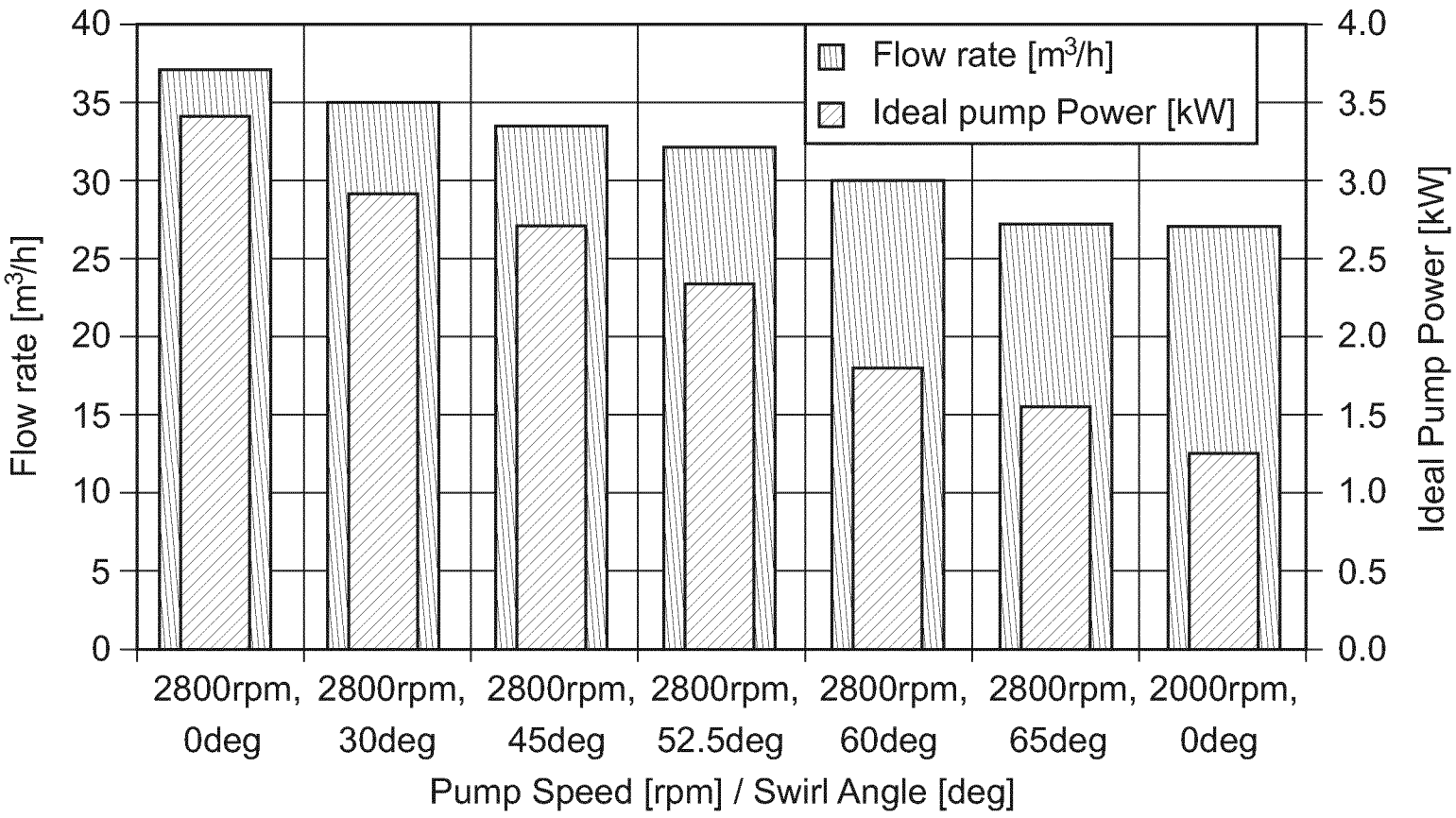
FIG. 10 shows a diagram illustrating the variation of the delivery flow rate of the pump and of the absorbed power of the pump itself, as the suction conditions vary.
Figure 14:
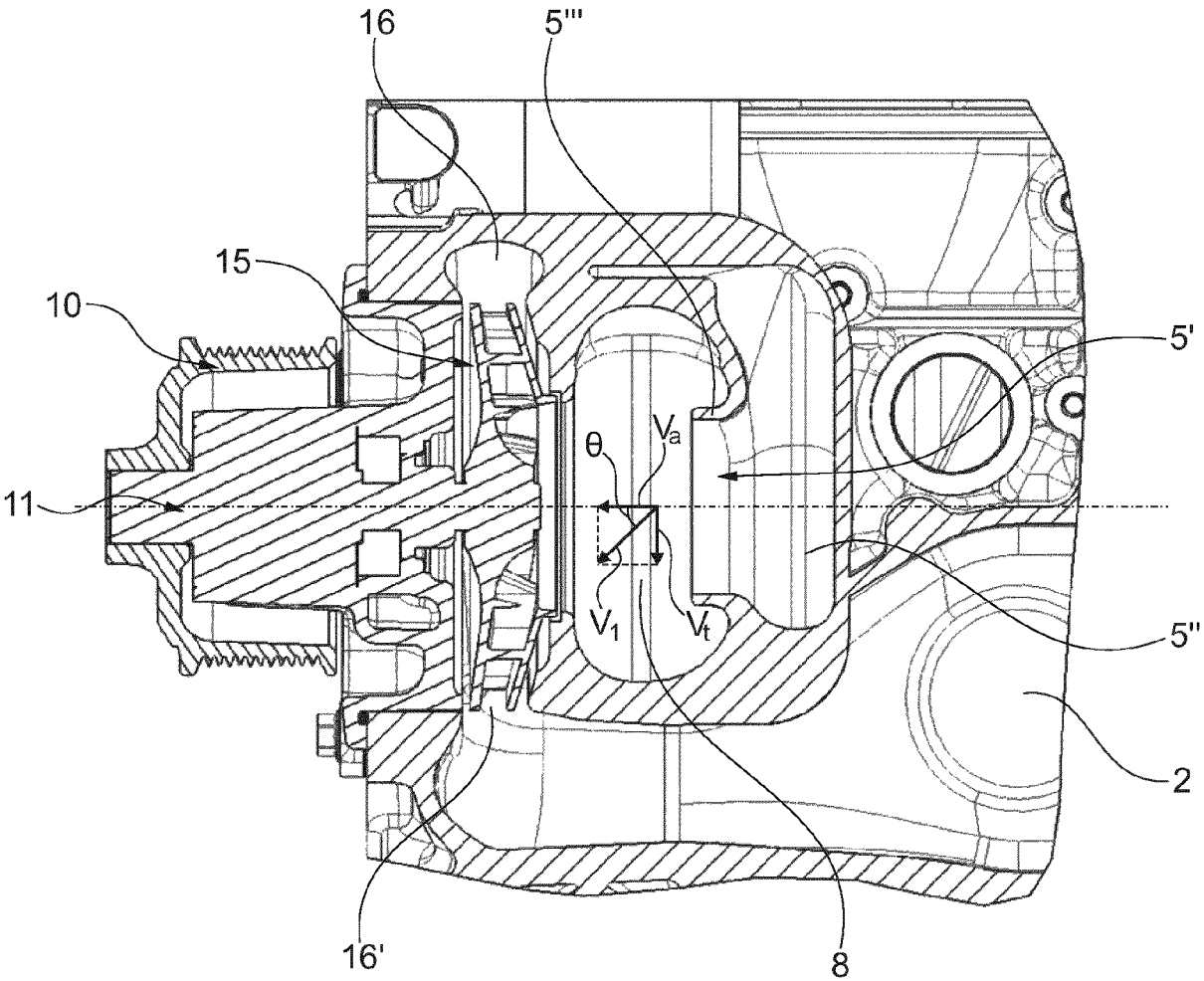
FIG. 14 shows a section view according to the line XIV-XIV indicated in FIG. 13.

In this regard FIG. 10 shows a further diagram illustrating the trend of the delivery flow rate [$m^3$/h] and of the absorbed power Pa [kW] as a function of the speed of rotation and of the width of the second opening 6' evaluated by a "swirl angle" θ indicated in the section view of FIG. 14. The swirl angle θ is substantially defined as the angle between the axis of rotation 4 and the direction of the absolute speed V1 of the water in the suction chamber 8. In particular such absolute speed is defined by the vector sum of the axial speed component Va (parallel to the axis of rotation 4) and of a tangential speed component Vt (orthogonal to the same axis of rotation) of the water. It is evident that the axial component Va is characteristic of the first axial flow, while the component Vt is characteristic of the second tangential flow namely of the "swirl motion" to which such second flow is subject in the suction chamber 8. As the flow rate of the second flow increases, it is evident that the tangential component Vt increases, while the axial component Va decreases, thus increasing in a corresponding way the swirl angle θ. The swirl angle θ is essentially characteristic of the value of the flow rate of the second flow entering the suction chamber 8.

As the diagram of FIG. 10 shows, considering a constant speed of rotation (2800 rpm), a progressive increase of the swirl angle θ (namely of the flow rate of the second flow) (between 0 and 65 degrees) implies a progressive decrease of the pump delivery flow rate ($m^3$/h) and a decrease of the power absorbed by the pump itself. FIG. 10 also shows that a variation of the flow rate of the second flow entering the chamber is substantially as efficient as a reduction of the speed of the pump, as shown by the bars of the diagram on the right. This means that the device 1 according to the invention allows to advantageously obtain the same results as the ones obtained by a variation of the speed of the impeller imposed by an electric motor of by an electromagnetic coupling as in the known solutions. Unlike the latter, however, the device according to the invention allows a reduction of costs and ensures water delivery even in case of failure of the partition means 9. Indeed, even in this case, the centrifugal pump keeps working providing a certain delivery flow rate, since water passes through one of the two ducts 5, 6 feeding the pump and the impeller rotates all the time driven by the motor.

As indicated above, figures from 11 to 18 show an embodiment of the invention where the device 1 for water circulation is substantially integrated in the crankcase 3 and is intended to be cooled by the cooling circuit. In particular, in this embodiment a portion 2 of the crankcase 3 defines, in a single piece, the housing 16 where the impeller 15 will be housed, the suction chamber 8, at least an end segment 5" of the first duct 5, at least an end segment 6" of the second duct 6 and at least an end segment 7" of the bypass duct 7 defined below.

Figure 11:
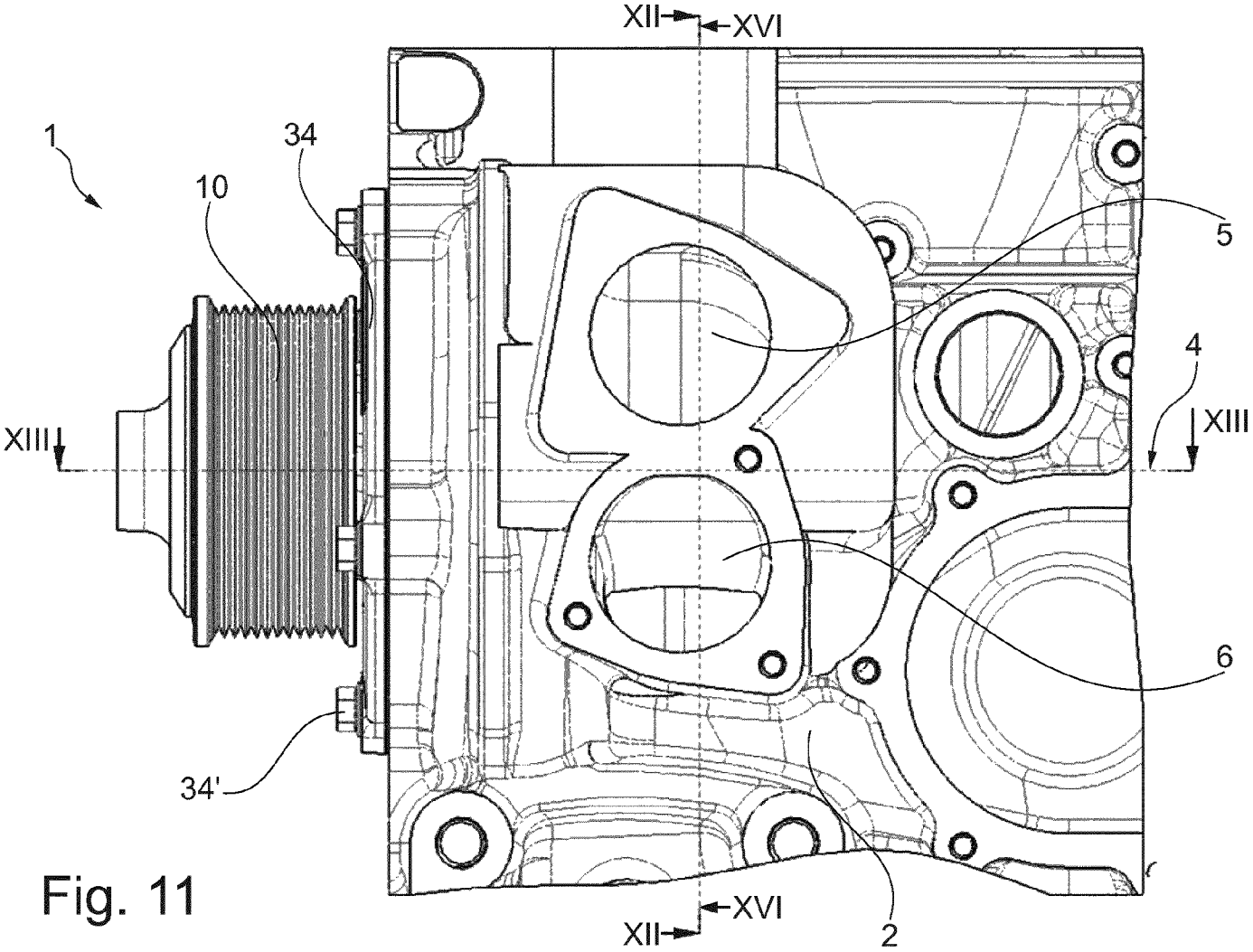
FIG. 11 shows a view of related to a possible embodiment of a device according to the present invention.
Figure 13:
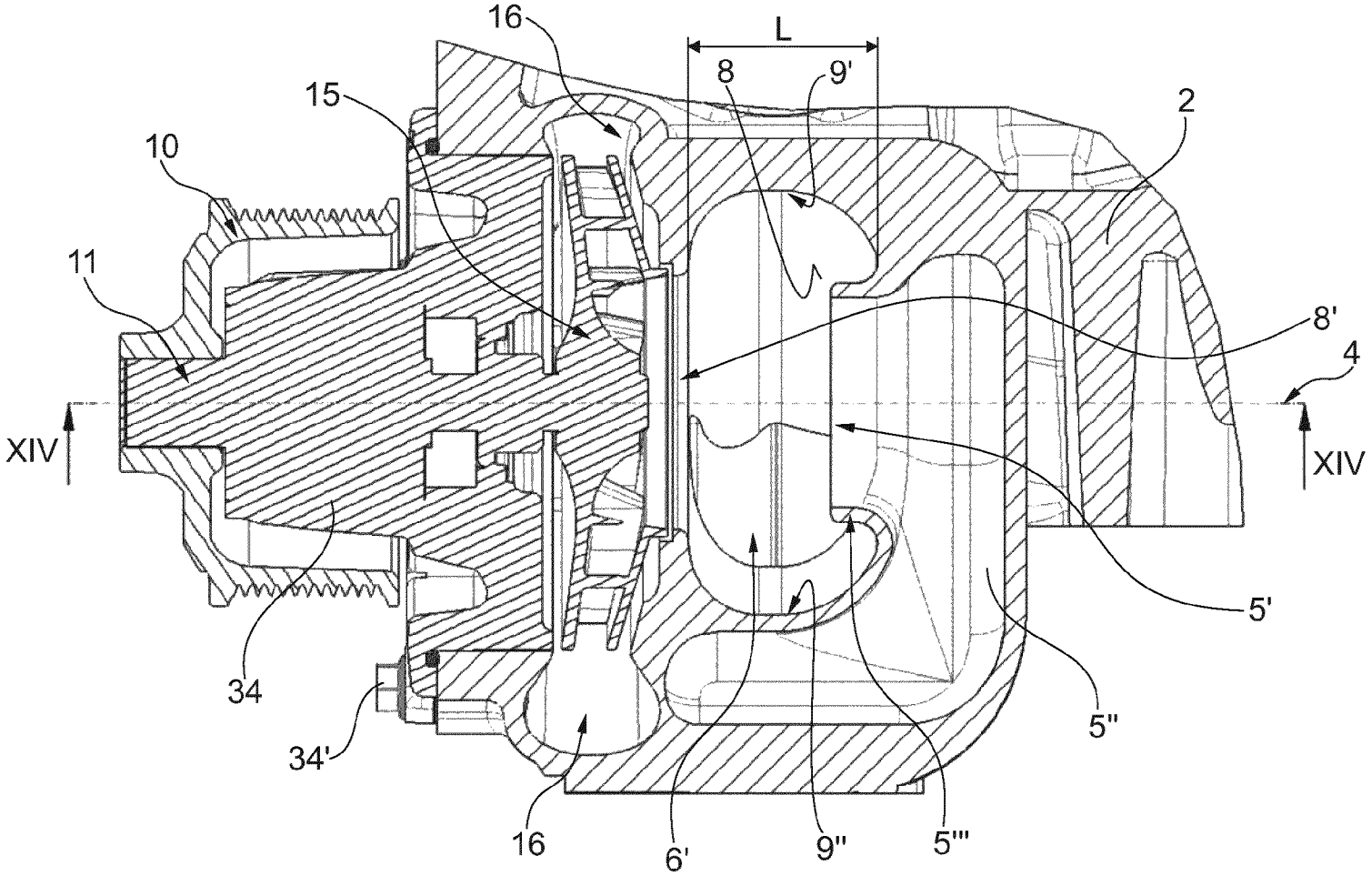
FIG. 13 shows a view according to the line XIII-XIII indicated in FIG. 11.

FIGS. 11 and 13 are a lateral view and a section view, respectively, of such portion 2 of crankcase. In particular, FIG. 13 allows to observe the configuration of the housing 16 where the impeller 15 of the pump is placed. Such impeller 15 is mounted on an impeller holder block 34 connected to the portion 2 of the crankcase by means of screw connection means 34' (also shown in FIG. 11). More precisely, the impeller 15 is mounted at a first end of a shaft defining the axis of rotation 4 for the impeller itself. At a second end of the same shaft, opposed to the first one, a pulley 10 is keyed which can be connected to the shaft 3' of the engine 3 by means of a transmission 101 according to the operating scheme shown in FIG. 1.

Figure 12:
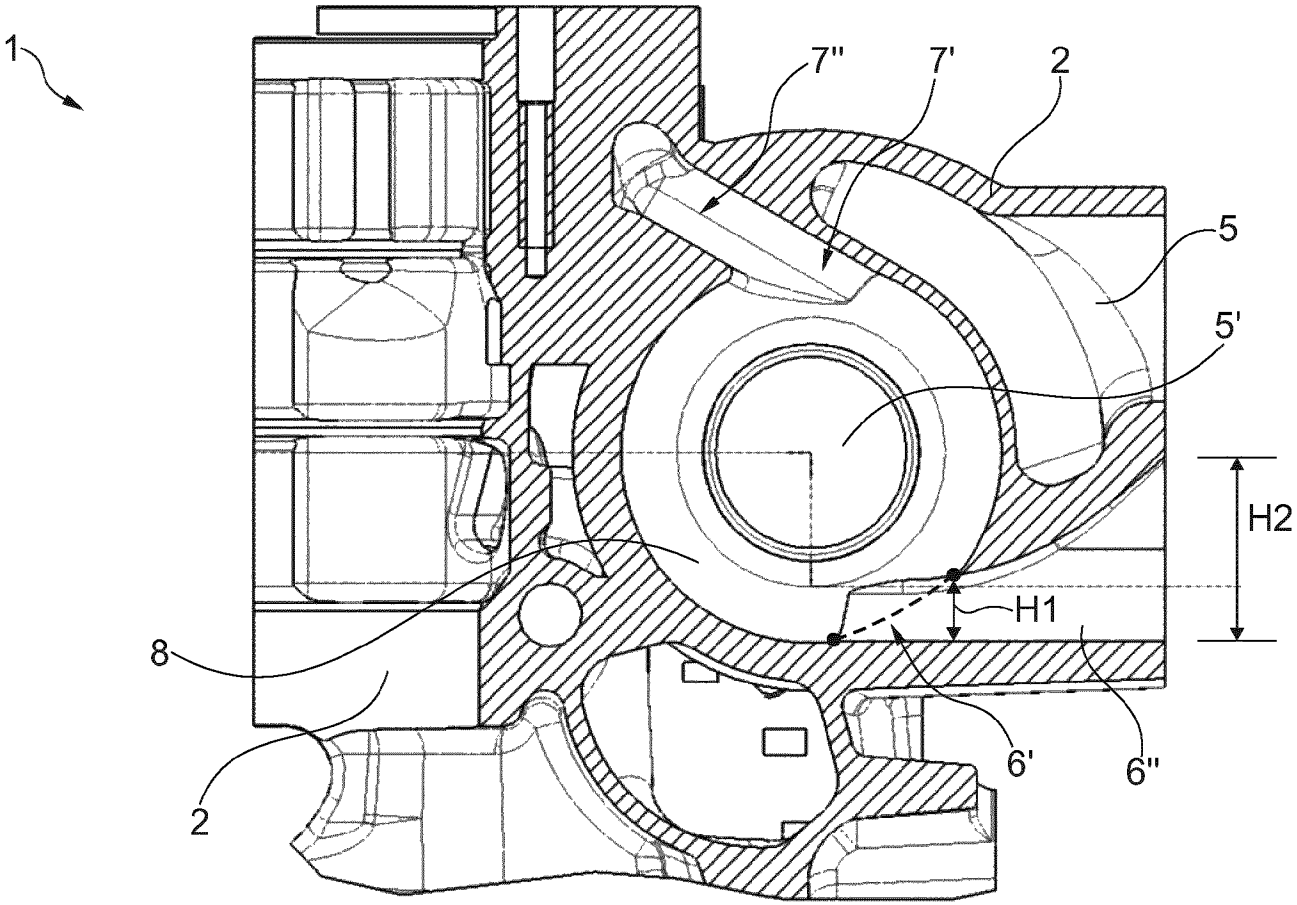
FIG. 12 shows a section view according to the line XII-XII of FIG. 11.

With particular reference to the section views in FIGS. 12 and 13, as shown above, the portion 2 of the crankcase 3 defines also the suction chamber 8. In particular, in FIG. 12 it is possible to observe the substantially circular development of the chamber 8 around the axis 4. While, with reference with FIG. 13, it is possible to observe that the chamber 8 has a circular section whose extension varies as a function of the position of the section itself around the axis 4. In other words, the profile of the chamber 8, evaluated in relation to a longitudinal section plane, namely containing the axis 4, has a first segment 9' and a second segment 9" that are symmetrical in relation to the axis 4 and have a substantially curvilinear progress.

With reference again with FIG. 13, the chamber 8 defines the first opening 5' that communicates with the first duct 5. The first opening 5' is substantially circular and orthogonal to the axis 4 of the impeller, while the end segment 5" of the duct 5' has a cylindrical portion 5'". Such portion 5'" develops coaxially with the axis 4 and has a cross section substantially equivalent to the one of the first opening 5'. This particular shape of the part 5'" allows to optimize the axial intake of the first flow in the chamber 8, namely to optimize the orientation of the first flow itself according to the axis 4 of the impeller 15.

With reference again to the view in FIG. 12, as provided by the present invention, the chamber 8 comprises a second opening 6' that communicates with the second duct 6. As indicated above, such second opening 6' defines a "tangential inlet" for the second water flow in the chamber 8 such that it generates a "swirl motion" (rotation around the axis 4) with the second flow within the chamber itself. The position of the second opening 6' and the direction of rotation of the impeller 15 are defined so that the rotation of the water within the chamber 8 have the same direction as the rotation of the impeller 15. As discussed above, in these conditions, a modulation of the flow rate of the water subject to such rotation (namely modulating the flow rate of the second flow) it is possible to vary the pump delivery flow rate.

Figure 15:
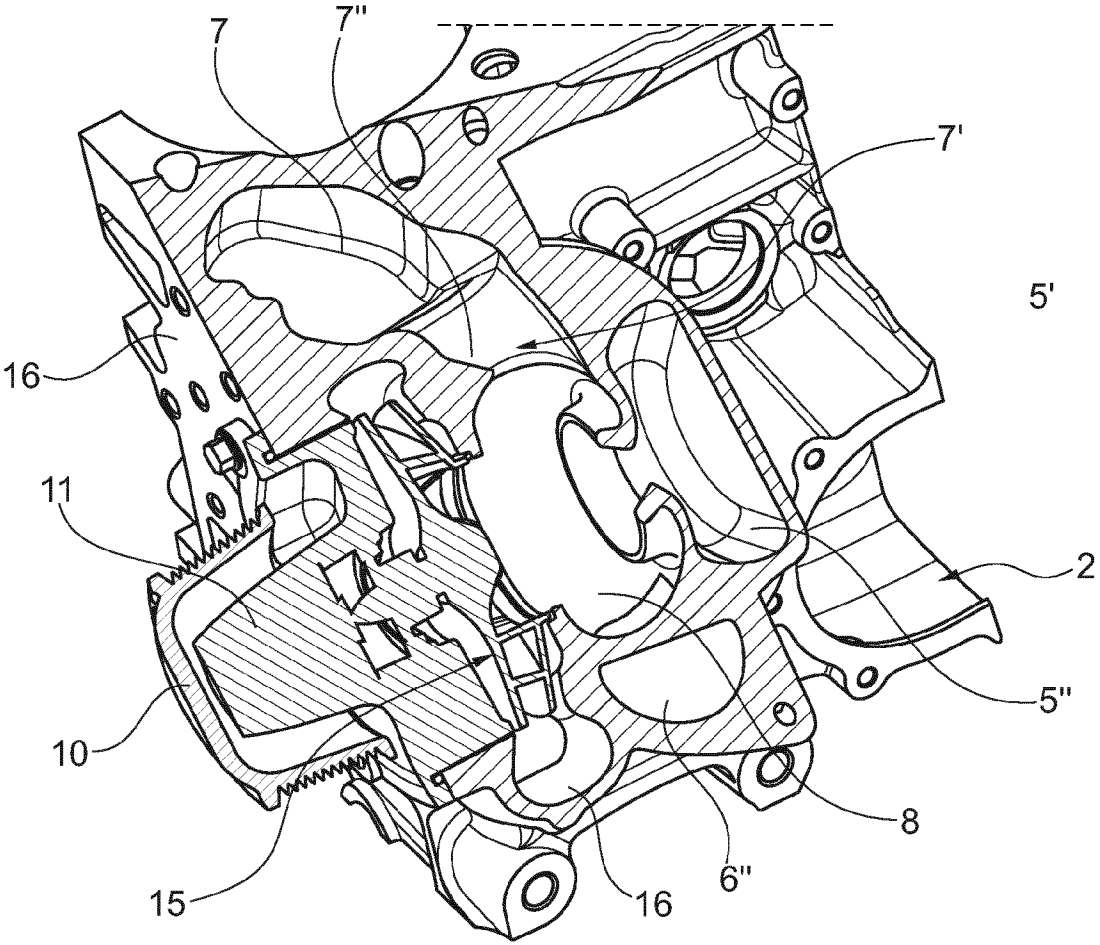
FIG. 15 shows an a first perspective section view of the device of FIG. 11.

According to a first aspect of the present invention, the area of the second opening 6' is smaller than the area of the first opening 5' in order to advantageously increase the speed of the second flow entering the chamber 8, namely in order to increase the intensity of the rotation (swirl motion) within the chamber itself. The different area of the two openings 5' and 6' can be seen in the perspective section views shown in FIGS. 15, 16 and 17.

According to a preferred embodiment of the invention, the first duct 5 has, along its extension from the manifold 50 to the chamber 8, a substantially constant section for the passage of water. On the contrary, the second duct 6, has at least an end segment 6", communicating with the second opening 6' of the chamber 8, which has a passage section which reduces progressively up to a minimum value in the proximity of the second opening 6' of the chamber 8. In other words, such end segment 6" of the second duct 6 is substantially "nozzle-shaped" namely the water passage section reduces progressively between a maximum and a minimum value with a trend, for example, of the parabolic type. In this regard, reference H1 in FIG. 12 indicates the extension of the water passage minimum section of the end segment 6" of the second duct 6 defined in the proximity of the second opening 6'. Reference H2 indicates instead the extension of the maximum passage section of the same end segment 6". Extensions H1 and H2 are evaluated with respect to sections defined by a plane substantially orthogonal to the water flow lines of the second flow.

The different shape provided for the passage section of the two ducts 5, 6 of the device 1 is such that the first duct 5 constitutes a preferential path for the water addressed to the suction chamber 8, since the flow resistance in it are relatively limited. On the contrary, the second duct is subject to high flow resistance, above all due to its nozzle-shaped end segment 6". This means that if the partition means 9 do not split the flow rate, the whole water flow rate leaving the manifold 50 tends "naturally" to pass through the first duct 5, since it is easier to pass through it. As a consequence, the flow rate in the second duct 6 is almost equal to zero. As already indicated above, such condition is characteristic of a full load operating condition of the engine, namely a condition wherein the highest pump delivery flow rate is required.

As a consequence of the decrease of the delivery flow rate required (partial load operating condition), a fraction of the water flow rate leaving the manifold 50 will be "forced", by intervention of the partition means, to pass through the second duct 6. The "nozzle-shaped" end segment 6" of the second duct 6 results, from the one end, in an increase of the speed of the water entering the chamber 8, and from the other end in an increase of the flow resistance of the cooling circuit as a whole. Both effects are advantageously synergic in terms of a decrease of the pump delivery flow rate. The increase of the speed of the second flow entering the chamber 8 amplifies the "swirl" effect within the chamber 8 itself, provoking, as discussed above, a variation of the curve P-Q in terms of a decrease of the characteristics values of the curve itself. At the same time, however, the increase in the flow resistance, due to the passage of water in the second duct 6, provokes a variation also of the system curve, and thus of the "point of work" of the centrifugal pump indicated above. In this sense in FIG. 8 the dashed line indicates a possible system curve taking into account the flow resistance occurring also inside the second duct. It can be observed that the definition of a new point of work (indicated by P2) results in a delivery flow rate value further decreased with respect to the one (indicated by P1) due to the "swirl motion" alone. Such flow rate reduction advantageously results in a further reduction of the power absorbed by the pump.

With reference to the schematization in FIGS. 2 and 3 and to the section view of FIG. 12, the chamber 8 comprises a third opening 7' which allows a third water flow (in the following called by-pass flow) to enter the chamber itself passing through a by-pass duct 7 of the cooling circuit wherein the device 1 according to the present invention is operatively inserted. In this regard, the portion 2 of the crankcase defines at least an end segment 7" of such by-pass duct 7. The water passage in the by-pass duct is regulated by a thermal expansion valve 78 (indicated in FIG. 1) which is activated/deactivated as a function of the temperature reached by the water after the heat exchange with the engine to be cooled, according to principles explained below. The third opening 7' defines a tangential inlet to the suction chamber 8 for the third water flow. Also in this case "tangential inlet" indicates a condition such that the third water flow from the by-pass duct 7 passes through the second opening 7' so that it rotates around the axis of rotation 4 of the impeller 15 (swirl motion) with the same direction of the impeller itself.

With reference to FIGS. 2 and 3, the by-pass duct 7 has a water passage section preferably variable along its extension and more precisely "converging" towards the third opening 7'. In other words the by-pass duct comprises an end segment 7" whose water passage section shrinks progressively until it converges in the third opening 7'. In short, the end segment 7" of the by-pass duct 7 is "nozzle-shaped", similarly to the one of the second duct 6 discussed above.

The "tangential" shape of the third opening 7' and the "converging" shape of the end segment 7" allow, during the activation of the by-pass duct 7, to obtain an advantageously reduction of the delivery flow rate of the circulation pump for the same principle indicated above regarding the second duct 6 and the second opening 6'. In particular, thanks to the "swirl motion" of the by-pass flow within the chamber 8, the pump will provide a lower flow rate, an effect adds to the flow resistance increase due to the passage in the same by-pass duct. As it will be explained better below, the reduction of the pump delivery flow rate during the activation of the by-pass circuit 7, namely during the starting of the engine, allows a fast engine warming, since the decrease of the flow rate reduces the heat dissipation.

The section view of FIG. 13 allows to observe the second opening 6' from a different point of view with respect to the one of FIG. 8 and more precisely according to a longitudinal section plane XIII-XIII (indicated in FIG. 11) containing the axis 4 of the impeller 15. In particular, in FIG. 13 it is possible to observe that the second opening 6' extends substantially along the whole length L of the suction chamber 8, evaluated along a direction parallel to the direction of the axis 4. This solution allows to optimize the inlet of the second flow in the chamber 8 and the swirl motion within the chamber itself.

Figure 17:
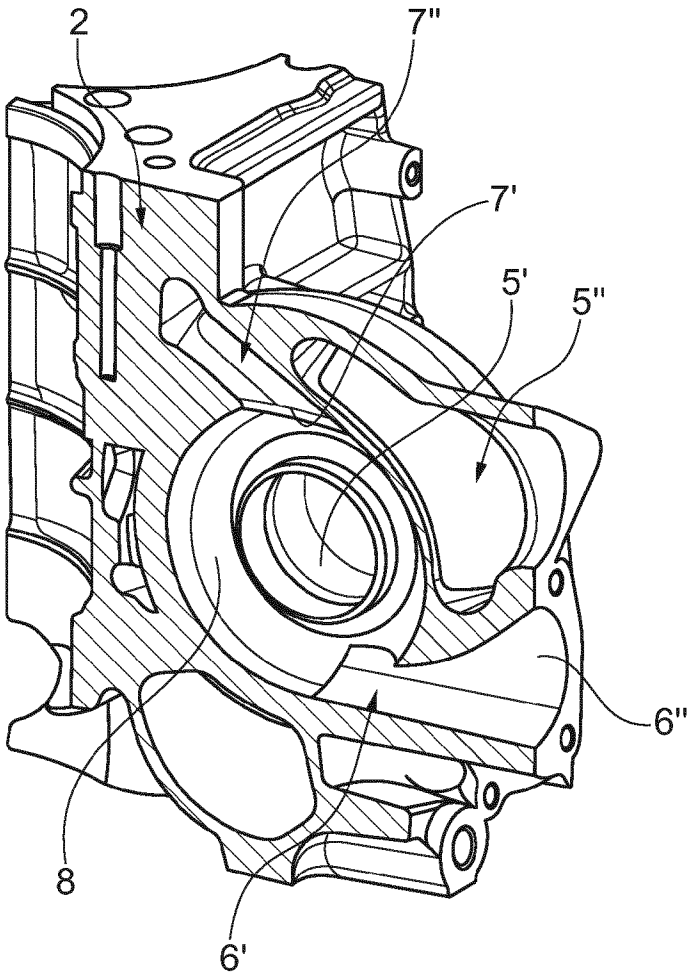
FIGS. 16 and 17 are perspective views according to the line XVI-XVI and XII-XII indicated in FIG. 11.
Figure 16:
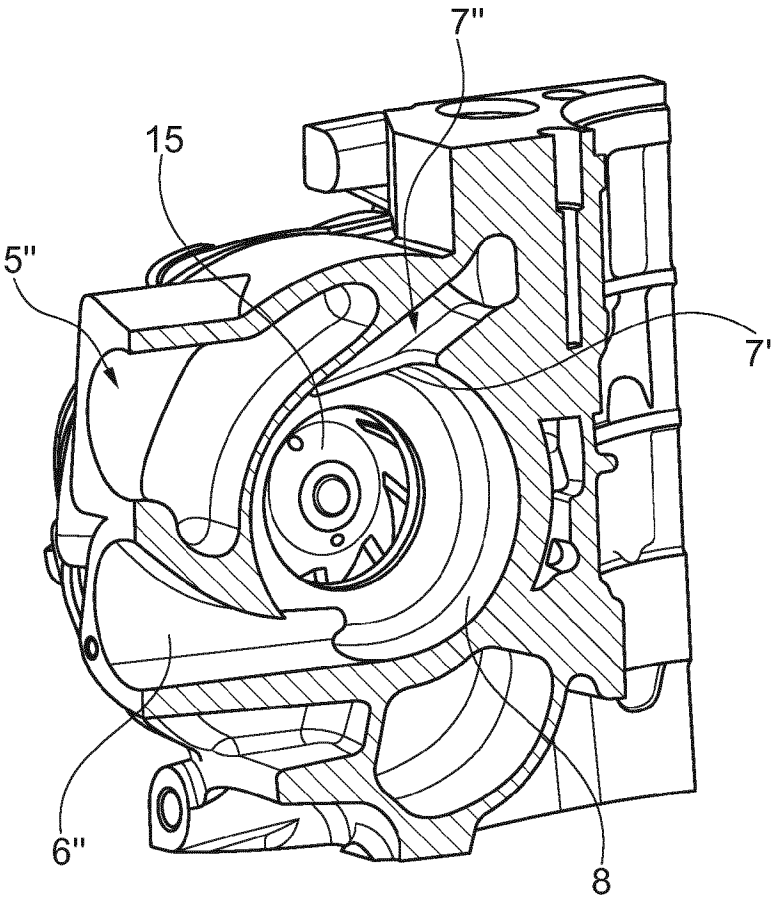

FIGS. 16 and 17 are perspective views of the portion 2 of the crankcase respectively according to the section plane XVI-XVI and XII-XII of FIG. 11. Such figures allow to further observe the "nozzle-shaped" configuration of the end part 6" of the second duct 6 and of the end part 7" of the by-pass duct 7. At the same time it is evident from these figures that the end segment 5" of the first duct 5 is not nozzle-shaped, but, on the contrary, in the proximity of the first opening 5', its water passage section tends to be even larger where it joins to the first opening 5' itself by means of the part 5'" of the end segment 5". The shape of the first duct 5 allows to keep a substantially constant speed in the first duct 5 and a relatively limited flow resistance. As already indicated above, the shape assigned to the first duct 5 allows it to be a preferential duct for the water leaving the manifold 50 according to the purposes and the principles already indicated above.

FIG. 14 allows to observe the pump delivery section. The housing 16 containing the impeller 15 has the typical spiral shape of hydraulic pumps and defines a pump delivery section 16' communicating with a cooling line 12 of the circuit 11. In this regard, an arrow in FIG. 14 shows the direction of movement of the water from the delivery section along the cooling line. FIG. 14 shows only the initial segment of such cooling line, which develops mostly in the crankcase, depending on the type and on the dimensions of the engine 3.

With reference again to FIGS. 2 and 3, in one of their possible embodiments, the partition means 9 can be throttle valves placed inside the first duct 5 in order to regulate the flow rate of the first flow and consequently the flow rate of the second flow. In a condition of fully open throttle valve, the whole water flow rate leaving the manifold passes through only the first duct 5, being it preferential, namely with reduced flow resistance. A progressive closing of the throttle valve determines a reduction of the water flow rate (first flow) in the first duct 5 and an increase of the flow rate in the second duct 6 since the flow rate at the outlet of the manifold 50 is constant. This condition results in an increase of the water flow rate subject to the "swirl motion" in the chamber 8 and consequently in a decrease of the delivery flow rate of the circulation pump.

In a condition of fully closed throttle valve, all the water leaving the manifold is "forced" to pass through the second duct 6. This condition amplifies the "swirl" effect in the chamber 8 to the utmost, since all the water flow rate leaving the manifold enters the suction chamber 8 only through the second opening 6'. At the same time, there will be an increase of the flow resistance since the water passes through the second duct 6, which, as said, is a synergetic effect in terms of decrease of the flow rate.

The present invention relates also to a cooling circuit for internal combustion engine of a vehicle comprising the device 1 according to the invention. In this sense, FIG. 1 is a schematization of a cooling circuit according to the invention indicated by the reference 11.

In addition to the device 1 described above, the cooling circuit comprises a cooling line 12 connected from one side to the delivery section 16' of the pump of the device 1 and from the other side to a thermal expansion valve 78 already indicated above. The cooling line 12 is defined within the engine crankcase 3 and is the only inlet of the thermal expansion valve 78. The latter, on the contrary, has a first outlet 78' connected to the by-pass line 7 and a second outlet 78" connected to a return line 12'. The latter hydraulically connects the thermal expansion valve 78 with the inlet of a radiator 40. The outlet 41 of the radiator 40 is connected with the inlet of the manifold 50 of the device 1 according to the invention.

The cooling circuit 11 according to the invention is regulated as a function of the operating conditions of the engine and by means of the intervention of a thermal expansion valve and/or of the partition means 9 of the device 1 described above. In this regard, a method for the regulation of the cooling circuit 11 will be described below supposing the use of a throttle valve (in the following indicated as valve 9) placed in the first duct 5 of the device 1 as a partition means 9.

Until the water temperature is below a first predetermined value T1, the thermal expansion valve 78 has a first operating configuration according to which the first outlet 78' of the valve 78 is open and the second outlet 78" connected to the return line 12', is closed. This regulation step is characteristic of a condition when the engine has just been started. In such condition, the water sent at the pump delivery (cold) passes through the cooling line 12' defined in the body/crankcase of the engine 3 and returns back to the suction flowing only in the by-pass duct 7. As indicated above, the third opening 7' of the chamber 8 is shaped so that it makes the by-pass flow rotate within the chamber itself in the same direction of the pump impeller 15. According to the operating principle described above, the rotation of the water within the chamber 8 results in a reduced head provided by the centrifugal pump, this effect being added to the flow resistance due to the throttle-shaped end part 7" of the by-pass duct 7. Both effects are synergetic and bring to a reduction of the flow rate in the cooling line 12, namely to a fast warming up of the engine 3. Being the warming up of the engine 3 fast, the production of smoke is minimized and the oil reaches its operating temperature in a short time, the latter condition ensuring low friction and thus low fuel consumption.

The regulation method according to the invention comprises a second step according to which when the temperature of the water exceeds said first predetermined value T1 and until the temperature is below a second predetermined value T2, higher than T1, the valve 78 passes gradually from a first operating configuration to a second operating configuration according to which the first outlet 78' is closed and the second outlet 78" is closed. The expression "gradually" means an operating variation of the valve such that the first opening (towards the by-pass 7) of the valve is "gradually closed", while the second opening (towards the radiator 40) of the valve is "gradually opened" up to the second operating configuration.

This second regulation step is characteristic of a condition when the engine has reached its "average temperature". In other words, when T1 is exceeded, the thermal expansion valve starts to gradually open the outlet towards the radiator 40 and to gradually close the one of the by-pass. In these conditions, the throttle valve 9 is still kept closed. This means that the water from the radiator 40 will be diverted to the second duct 6 of the device 1. Until the temperature of the water will be comprised between T1 and T2, the water flow returning back to the pump intake will be split between the by-pass 7 and the second duct 6. Consequently all the water within the chamber 8 will be subject to a "swirl motion", so that the pump delivery flow rate will be kept low. The temperature of the water will be advantageously modulated by the "hot" water coming from the engine 3 and by the "cold" water coming from the radiator 50.

The regulation of the circuit 11 also provides that, when the water temperature exceeds T2, the thermal expansion valve 78 keeps said second operating configuration. When, on the contrary, the water temperature exceeds a second predetermined value T3, higher than T2, then the partition means 9 (throttle valve) are activated in order to slip the water flow rate addressed to the pump intake between the first duct 5 and the second duct 6 of the device 1. More precisely, according to the present invention, the distribution of the flow rates in the two ducts 5 and 6 is made so that the flow rate in the first duct 5 is increased in a way proportional to the temperature reached by the water at the outlet of the cooling line 12.

In other words, when the temperature of the water exceeds T2, the thermal expansion valve 78 keeps the second operating configuration by closing the passage through the bypass 7. Consequently the whole flow rate is sent to the radiator and then to the chamber 8 of the pump only through the second duct 6.

From this moment on, the regulation of the circuit is performed only by the partition means 9. In particular, when the temperature of the water exceeds a third predetermined value T3, higher than T2, the partition means 9 split the water flow rate leaving the manifold 50 partially in the first duct 5 and partially in the second duct 6. The throttle valve 9, when the temperature T3 is reached, substantially takes a position wherein both ducts 5, 6 are passed through a certain predetermined flow rate. This, of course, results in an increase of the pump delivery flow rate.

The third value T3 corresponds to an optimal temperature determined as the maximum temperature for which the engine reliability is ensured and the oil of the engine itself does not deteriorate. When T3 is reached, the partition means increase the pump delivery flow rate and keep the water temperature at a value near to T3.

A further step of the regulation method of the cooling circuit according to the invention provides that, when the water temperature exceeds a fourth predetermined value T4, higher than T3, the regulation means act so that the whole water flow rate passes through the first duct 5. Namely when T4 is reached, the throttle valve 9 takes a fully open position, allowing water to pass through the "preferential path" made by the first duct 5. In these conditions, the hydraulic pump works as a traditional centrifugal pump with a water inlet completely axial. Reaching temperature T4 means that the engine works in full load condition, which requires the highest pump delivery flow rate in order to effectively cool the engine.

The device according to the invention allows to fulfil the purposes set forth above. In particular, the device allows to vary the pump delivery flow rate as a function of the operating conditions of the engine. In particular, such variation of the flow rate is obtained by a variation of the conditions of the water flow at the pump intake. The device according to the invention is reliable and easy to manufacture with competitive costs.

The device according to the invention can be subjected to numerous variations or modification, without departing from the scope of the invention; moreover all the details may be replaced by others that are technically equivalent.

In practice, the material used and also the dimensions and the shapes may be any, according to the needs and to the state of the art.

The invention claimed is:

1. Device (1) for water circulation in a cooling circuit of an internal combustion engine (3), said device (1) comprising:

a water circulation pump comprising a body (2) defining a housing (16) for a bladed impeller (15) rotating around an axis (4), said impeller (15) being driven by a shaft (3') of said engine (3) by means of a mechanical transmission (101);

a suction chamber (8) defining an intake section (8') for said impeller (15), said chamber (8) having a circular development around said axis (4);

a water manifold (50) that can be connected town outlet of a radiator (40) of said cooling circuit;

a first duct (5) feeding said chamber (8) connected to a first outlet of said manifold (50) in order to be passed through a first water flow, said first duct (5) being connected to said suction chamber (8') by means of a first opening (5') of said chamber (8) which defines an axial inlet for said first flow in said first chamber (8);

a second duct (6) feeding said chamber (8) connected to a second outlet of said manifold (50) in order to be passed through a second water flow, said, second duct (6) being connected to said suction chamber (8') by means of a second opening (6') of said chamber (8) which defines a radially offset tangential inlet so that said second water flow is subject to a rotation around said axis (4) within said chamber (8);

a flow rate partition to vary the flow rate of the water circulating in said first duct (5) and in said second duct (6) as a function of operating conditions of said engine.

2. Device (1) according to claim 1, wherein said second opening (6') of said chamber (8) has a configuration so that it makes said second flow rotate within said chamber (8) in a same direction as the rotation, of said impeller (15) of said pump.

3. Device (1) according to claim 1, wherein said device (1) has a by-pass duct (7) suitable to be passed through by a third water flow, said by-pass duct being connected to said suction chamber (8') by means of a third opening (7') of said chamber (8) which defines a tangential inlet so that said third water flow is subject to a rotation around said axis (4) within said chamber (8).

4. Device (1) according to claim 3, wherein said third opening (7') of said chamber (8) has a configuration so that it makes said third flow rotate within said chamber (8) in a same direction as the rotation of said impeller (15) of said pump.

5. Device (1) according to claim 1, wherein said partition means comprise a throttle valve placed within said first duct (5) of said suction chamber (8).

6. Device (1) according to claim 1, wherein said second duct (6) feeding said suction chamber (8) comprises an end segment (6") communicating with said second opening (6') which has a water passage section which shrinks progressively from a maximum value (H2) to a minimum value (H1) according to a nozzle shape.

7. Device (1) according to claim 3, wherein said by-pass duct (7) comprises an end segment (7") communicating with said third opening (7') which has a water passage section which shrinks progressively from a maximum value to a minimum value according to a nozzle shape.

8. Device (1) according to claim 1, wherein said manifold (50) is defined by a sleeve comprising:

an inlet that can be connected to said radiator (40) of said cooling circuit (11);

a first outlet connected to said first duct (5);

a second outlet connected to said second duct (6).

9. Device (1) according to claim 1, wherein said body (2) is formed by a portion of a crankcase of said engine.

10. Cooling circuit (11) for cooling an engine (3), comprising:

a cooling line (12) of the engine (3);

a thermal expansion valve (78) comprising an inlet connected to said cooling line (12);

a by-pass line (7) connected to a first outlet of said thermal expansion valve (78);

a return line (12') connected to a second outlet of said thermal expansion valve (78);

a radiator (40) whose outlet is connected to said return line (12'); and a device (1) for water circulation according to claim 1 wherein:

said manifold (50) of said device (1) is connected to said radiator (40);

said by-pass line (7) is connected to said suction chamber (8) of said device (1);

said impeller (15) of said pump of said device (1) is driven by the driving shaft (3') of said engine (3) by means of a mechanical transmission (101).

11. Regulation method according to claim 10, wherein said method comprises the further steps of:

cancelling, by means of said partition means (9), a flow rate of said first flow in said first duct (5) until the water temperature at the outlet of the cooling line (12) is below a third predetermined value (T3), higher than said second value (T2); and split in a predetermined way, by means of said partition means (9), the flow rate leaving the manifold (50) between said first duct (5) and said second duct (6) until the water temperature at the outlet of the cooling line (12) exceeds said third value (T3).

12. Industrial or commercial vehicle, comprising a diesel engine, characterized in that it comprises a cooling circuit according to claim 10.

13. Method for regulating a cooling circuit (11), said cooling circuit (11) including:

a cooling line (12);

a thermal expansion valve (78) comprising an inlet connected to said cooling line (12);

a by-pass line (7) connected to a first outlet of said thermal expansion valve (78);

a return line (12') connected to a second outlet of said thermal expansion valve (78);

a radiator (40) whose outlet is connected to said return line (12'); and a device (1) for water circulation, said device (1) including:

a water circulation pump comprising a body (2) defining a housing (16) for a bladed impeller (15) rotating around an axis (4), said impeller (15) being driven by a shaft (3') of said engine (7) by means of a mechanical transmission (101);

a suction chamber (8) defining an intake section (8') for said impeller (15), said chamber (8) having a circular development around said axis (4);

a water manifold (50) that can be connected to an outlet of a radiator (40) of said cooling circuit;

a first duct (5) feeding said chamber (8) connected to a first outlet of said manifold (50) in order to be passed through a first water flow, said first duct (5) being connected to said suction chamber (8') by means of a first opening (5') of said chamber (8) which defines an axial inlet for said first flow in said first chamber (8);

a second duct (6) feeding said chamber (8) connected to a second outlet of said manifold (50) in order to be passed through a second water flow, said second duct (6) being connected to said suction chamber (8') by means of a second opening (6') of said chamber (8) which defines a tangential inlet so that said second water flow is subject to a rotation around said axis (4) within said chamber (8); and a flow rate partition means (9) suitable to vary the flow rate of the water circulating in said first duct (5) and in said second duet (6) as a function of operating conditions of said engine, wherein said manifold (50) of said device (1) is connected to said radiator (40), said by-pass line (7) is connected to said suction chamber (8) of said device (1), and said impeller (15) of said pump of said device (1) is driven by the driving, shaft (3') by means of a mechanical transmission (101);

said method for regulating said cooling circuit (11) comprising the steps of:

keeping, when a temperature of water at the outlet of the cooling line (12) is below a first predetermined value (T1), said valve (78) in a first operating configuration so that said first outlet (78') of the valve (78) is open and said second outlet (78") of said valve (78) is closed;

varying gradually, when the temperature of the water at the outlet of the cooling line (12) exceeds said first value (T1) and does not exceed a second predetermined value (T2) higher than said first value (T1), the operating configuration of said valve (78) from said first operating configuration to a second operating configuration according to which said first outlet (78') of the thermal expansion valve (78) is closed and said second outlet (78") of said thermal expansion valve (78) is open; and keeping firmly said second valve (78) in said second operating configuration when the water temperature at the outlet of the cooling line (12) exceeds said second value (T2).

* * * * *